US006155569A

United States Patent [19]

Horiuchi et al.

[11] Patent Number: 6,155,569

[45] Date of Patent: Dec. 5, 2000

[54] GOLF BALL

[75] Inventors: Kuniyasu Horiuchi, Kobe; Tadahiro Ebisuno; Keiji Moriyama, both of Nishinomiya, all of Japan

[73] Assignee: Sumitomo Rubber Industries, Ltd., Hyogo-ken, Japan

[21] Appl. No.: 08/037,366

[22] Filed: Mar. 26, 1993

[30] Foreign Application Priority Data

Mar. 26, 1992 [JP] Japan ..... 4-068226

[51] Int. Cl.[7] ..... A63B 63/00

[52] U.S. Cl. ..... 273/317; 273/317.2; 428/357; 428/402; 428/403; 428/407

[58] Field of Search ..... 273/235 R, 317, 273/317.2; 428/35.1–35.5, 357, 402, 403, 407

[56] References Cited

U.S. PATENT DOCUMENTS

| | | | |
|---|---|---|---|
| 4,679,795 | 7/1987 | Melvin et al. | 273/235 R |
| 4,798,386 | 1/1989 | Berard | 273/235 R |
| 5,000,458 | 3/1991 | Proudfit | 273/213 |
| 5,029,870 | 7/1991 | Concepcion et al. | 273/220 |
| 5,132,148 | 7/1992 | Reafler | 428/323 |

FOREIGN PATENT DOCUMENTS 2144045 2/1985 United Kingdom .

OTHER PUBLICATIONS

Database WPIL Week 9230, Derwent Publications Ltd., London, GB, AN 92–246345 & JP–a 4 166 173.

*Primary Examiner*—Ardin H. Marschel
*Attorney, Agent, or Firm*—Birch, Stewart, Kolasch & Birch, LLP

[57] ABSTRACT

A coated golf ball has an ionomer cover and a paint layer thereon, wherein an ionomer resin cover substantially contains no fluorescent brightener, Wcie reading which indicates whiteness after coating of the paint is within the range of 110 to 125, Tw reading which indicates greenishness is within the range of 4 to 6.5, and the Wcie (Cw) and Tw ($C_T$) reading of the cover and the Wcie (Pw) and Tw ($P_T$) reading obtained after coating of the paint have a following relation:

$$4 \leqq Pw - Cw \leqq 12$$

$$0 < C_T - P_T \leqq 1.2.$$

8 Claims, No Drawings

GOLF BALL

FIELD OF THE INVENTION

The present invention relates to a coated golf ball. More particularly, it relates to a coated golf ball which does not show remarkable color change even when the paint layer has a defect such as a scratch and peeling.

BACKGROUND OF THE INVENTION

Regarding a golf ball, a ball surface is scratched by a grooved clubface when it is shot by a golf club, particularly a short iron, whereby, a paint layer is sometimes peeled off.

Heretofore, a trial to put in the same color tone to both cover and paint have been made such that a golf ball does not show remarkable color change. In the combination of a cover and a paint layer both of which contain a brightener, it was certainly possible to prevent remarkable color change when a paint layer is peeled off, by putting in the same color to both the cover and paint. However, when the brightener is formulated into the cover of the golf balls, a degree of discoloration due to ultraviolet rays becomes large and it is not preferred.

Therefore, a golf ball wherein the brightener is not formulated into the cover but formulated into the paint layer has become popular. However, even by putting in the same color to both cover and paint layer, the golf ball remarkably shows scratches in comparison with golf balls in which the brightener is formulated into both cover and paint, and the improvement has been requested.

OBJECTS OF THE INVENTION

Main object of the present invention is to provide a coated golf ball which does not show remarkable color change due to a defect, such as a scratch and peeling of a paint layer, although the cover of the golf ball does not contain a fluorescent brightener.

This object as well as other objects and disadvantages of the present invention will become apparent to those skilled in the art from the following description.

SUMMARY OF THE INVENTION

According to the present invention, there is provided a coated golf ball which comprises a golf ball having an ionomer resin cover and a paint layer thereon, wherein the ionomer resin cover substantially contains no fluorescent brightener, Wcie reading which indicates whiteness after coating of the paint is within the range of 110 to 125, Tw reading which indicates greenishness is within the range of 4 to 6.5, and the Wcie (Cw) and Tw ($C_T$) reading of the cover and the Wcie (Pw) and Tw ($P_T$) reading obtained after coating of the paint have a following relation:

$$4 \leqq Pw - Cw \leqq 12$$

$$0 < C_T - P_T \leqq 1.2$$

DETAILED DESCRIPTION OF THE INVENTION

The golf ball of the present invention has an ionomer resin cover on a core. The ionomer resin may be anyone which is commercially available, and those which are available from Du Pont de Nemours & Co. under the trade name of SURLYN are preferred. If necessary, pigments (e.g. titanium dioxide, barium sulfate, etc.) may be formulated in an amount of 0.5 to 10% by weight, based on the weight of the ionomer resin of the cover. Furthermore, polyester, nylon, ionomer-polyester terpolymer and the like may also be formulated.

In the present invention, the ionomer resin cover is substantially free of fluorescent brightener(s). The description ". . . substantially free of fluorescent brightener(s)" means that the cover may contains a fluorescent brightener in such a small amount that the function thereof is insufficiently accomplished.

The golf ball of the present invention is coated with an enamel containing 0 to 12% by weight of a pigment or a clear paint. The enamel and clear paint can be urethane type, acryl type or epoxy type. The enamel or clear paint can be either solvent-borne or water-borne. Color matching of both cover and paint is conducted, using titanium dioxide in combination with suitable organic or inorganic pigment. As a main organic pigment, for example, there can be used insoluble azo pigment, condensed azo pigment, phthalocyanine pigment, quinacridone pigment, dioxane pigment and the like. As the inorganic pigment, for example, there can be used silicate, ferrocyanide, phosphate and the like. They may be appropriately combined. The pigment may preferably be contained in an amount of 0.0001 to 0.5% by weight, based on the weight of the resin content. The paint generally contains a fluorescent brightener. As the brightener, UVITEX OB (manufactured by Ciba-Geigy Ltd.) or WHITEFLOW (manufactured by Sumitomo Chemical Industries Co.) is used in an amount of 0.01 to 1.0% by weight, based on the weight of the resin content.

In the present invention, Wcie reading which indicates whiteness after coating of the paint is within the range of 110 to 125, preferably 112 to 123, Tw reading which indicates greenishness is within the range of 4 to 6.5, preferably 4.2 to 6.3, and the Wcie (Cw) and Tw ($C_T$) reading of the cover and the Wcie (Pw) and Tw ($P_T$) reading after coating of the paint have a following relation:

$$4 \leqq Pw - Cw \leqq 12$$

$$0 < CT - P_T \leqq 1.2$$

The Wcie and Tw readings are calculated from the following equations:

$$Wcie = Y + 800(Xo - x) + 1700(Yo - y)$$

$$Tw = 1000(Xo - x) - 650(Yo - y)$$

wherein Xo and Yo are chromaticity co-ordinates of perfect diffuse surface of $D_{65}$ illumination, and Xo is 0.3127 and Yo is 0.3291), based on whiteness of CIE ISO according to ISO 105-JOl: 1987 (E). When these values are not in the above range, the golf ball show remarkable color change when it is scratched or peeled off. That is, it became possible to prevent a defect from showing by enlarging Wcie as whiteness of the paint layer in comparison with that of the cover layer in a suitable range and by enlarging greenishness of the cover layer in comparison with that of the paint layer in a suitable range.

It is preferred that b* reading which indicates a yellowish-bluish in color difference on the coated golf ball is −5.0 to −10.0, preferably −6.0 to −9.0. When b* reading is larger than −5.0, the golf ball color becomes yellowish. Further, when b* reading is smaller than −10.0, the golf ball color becomes too bluish and is not suitable for appearance of the golf ball.

The L*a*b* color difference is calculated as described in the following equations, using tristimulus values according to JIS Z8701 or JIS Z8728.

$$L^*=116(Y/Yn)^{1/3}-16$$

$$a^*=500[(X/Xn)^{1/3}-(Y/Yn)^{1/3}]$$

$$b^*=200[(Y/Yn)^{1/3}-(Z/Zn)^{1/3}]$$

wherein Xn, Yn and Zn are tristimulus values in XYZ system of perfect diffuse reflection surface.

According to the above equations, "L*" reading represents lightness and "a*" and "b*" readings represent chromaticity. Particularly, "a*" reading represents a red-green direction and "b*" reading represents a yellow-blue direction. Further, when "L*" reading becomes larger, lightness becomes larger. When "a*" reading becomes larger, the color becomes red. When "b*" reading becomes larger, the color becomes yellow.

In the present invention, L*a*b* color difference is measured, using a calorimeter (commercially available from Minolta Co. as CR-221).

By changing conditions such as a kind and amount of a pigment as well as kind of cover and paint, control of a color tone can be conducted.

According to the present invention, by combining color tone of the cover with that obtained after coating of the paint in a suitable range, a golf ball having preferable white appearance and small weather discoloration, which does not show remarkable color change due to the defect after scratching can be obtained.

EXAMPLE

The following Examples further illustrate the present invention in detail but are not to be construed to limit the scope thereof.

Examples 1 to 6 and Comparative Examples 1 to 6

A two piece golf ball wherein an ionomer resin [SURLYN/$TiO_2$=98:2 (weight ratio)] was used as a cover was coated with a paint shown in Table 1 in the form of coating shown in Table 1. Appearance, discoloration after weathering and ease of showing after scratching of the resulting golf ball were evaluated. The results are shown in Table 1.

Test method (1) Measurement of color tone

By using a calorimeter CR221 manufactured by Minolta Co. (2° visual field, 3 mmφ, light source $D_{65}$), Yxy measurement was conducted and color tone was calculated from the following equations [whiteness of CIE ISO]:

$$Wcie=Y^*800(XO-x)+1700(Yo-y)$$

$$Tw=1000(Xo-x)-650(Yo-y)$$

wherein Xo and Yo are chromaticity co-ordinates of perfect diffuse surface of $D_{65}$ lighting, and Xo is 0.3127 and Yo is 0.3291.

(2) Discoloration after weathering

A sample was treated by a Sunshine Weather-o-meter for 120 hours and ΔL*, Δa*, Δb* and ΔE* were determined from L*, a* and b* obtained before and after treatment by a colorimeter. Further, visual observation was conducted according to the following criteria (n=12).

A: Degree of discoloration is extremely small (good).

B: Degree of discoloration is large (inferior).

(3) Ease of showing after scratching

A professional golfer was allowed to hit at a club-head speed of about 30 m/second with a sand wedge and appearance was evaluated by the following criteria (n=12).

A: The golf ball hardly shows scratch.

B: The golf ball remarkably shows scratch.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

TABLE 1

| | Ex. 1 | Ex. 2 | Ex. 3 | Ex. 4 | Ex. 5 | Ex. 6 |
|---|---|---|---|---|---|---|
| Cover | | | | | | |
| Wcie (Cw) | 106 | 109 | 113 | 108 | 116 | 112 |
| Tw (Cr) | 5.0 | 5.3 | 5.5 | 5.8 | 5.4 | 5.8 |
| Brightener | none | none | none | none | none | none |
| After coating (% pigment content)[1)] | | | | | | |
| One-layer epoxy | 8 | — | — | 8 | — | — |
| Aqueous urethane | — | — | 0 | — | 8 | 0 |
| Urethane | — | 8 | — | — | — | — |
| Two-layer urethane | 8 | 5 | 0 | 5 | 0 | 0 |
| Wcie (Pw) | 113 | 116 | 118 | 118 | 123 | 123 |
| Tw ($P_T$) | 4.5 | 5.0 | 4.5 | 5.5 | 5.0 | 5.6 |
| Pw - Cw | 7 | 7 | 5 | 10 | 7 | 11 |
| $C_T$ - $P_T$ | 0.5 | 0.3 | 1.0 | 0.3 | 0.4 | 0.2 |
| Discoloration after weathering | A | A | A | A | A | A |
| Ease of showing after scratching | A | A | A | A | A | A |
| b* | −6.5 | −7.3 | −7.5 | −8.0 | −8.5 | −9.0 |

[1)]titanium dioxide

| | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|
| Cover | | | | | | | |
| Wcie (Cw) | 110 | 108 | 118 | 107 | 118 | 110 | 100 |
| Tw (Cr) | 4 | 5.8 | 5.6 | 5.8 | 6.0 | 5.8 | 4 |
| Brightener | 1) | 1) | none | none | none | none | none |

TABLE 1-continued

| After coating (% pigment content)[2] | | | | | | | |
|---|---|---|---|---|---|---|---|
| One-layer epoxy | 8 | — | 8 | — | — | 20 | 8 |
| Aqueous urethane | — | 0 | — | 8 | 0 | — | — |
| Urethane | — | — | — | — | — | — | — |
| Two-layer urethane | 0 | 0 | 5 | 0 | 0 | 20 | 5 |
| Wcie (Pw) | 110 | 118 | 118 | 123 | 123 | 115 | 102 |
| Tw ($P_t$) | 3.9 | 5.5 | 5.5 | 5.6 | 4.3 | 4.0 | 2.0 |
| Pw - Cw | 0 | 10 | 0 | 16 | 5 | 5 | 2 |
| $C_T$ - $P_T$ | 0.1 | 0.3 | 0.1 | 0.2 | 1.7 | 1.8 | 2.0 |
| Discoloration after weathering | B | B | A | A | A | A | A |
| Ease of showing after scratching | A | B | B | B | B | B | B |
| b* | −6.0 | −7.8 | −8.5 | −9.2 | −8.5 | −8.1 | −4.0 |

[1]contained
[2]titanium dioxide

What is claimed is:

1. A coated golf ball, comprising:

a core;

an ionomer resin cover substantially free of fluorescent brighteners; and a paint layer on said ionomer resin cover, said paint layer including an optical brightener in an amount of 0.01 to 1.0% by weight;

wherein the Wcie reading, indicating the whiteness, after coating of the ionomer resin cover with the paint layer is within the range of 110 to 125;

wherein the Tw reading, indicating greenishness, after coating of the ionomer resin cover with the paint layer is within the range of 4 to 6.5; and wherein Cw, which is the Wcie reading of the cover alone, and $C_T$, which is the Tw reading of the cover alone, and Pw, which is the Wcie reading of the ball surface after coating with the paint layer, and $P_T$, which is the Tw reading of the ball surface after coating with the paint layer, have the following relation:

$$4 \leqq (Pw-Cw) \leqq 12;$$

and $$0 < (C_T - P_T) \leqq 1.2.$$

2. The coated golf ball according to claim 1, wherein said optical brightener is a fluorescent brightener.

3. The coated golf ball according to claim 1, wherein the Wcie reading after coating of the ionomer resin cover with the paint layer is within the range of 112 to 123.

4. The coated golf ball according to claim 1, wherein the Tw reading is within the range of 4.2 to 6.3.

5. The coated golf ball according to claim 1, wherein b* reading in L*a*b* color difference is within the range of −5.0 to −10.0.

6. The coated golf ball according to claim 1, wherein b* reading in L*a*b* color difference is within the range of −6.0 to −9.0.

7. The coated golf ball according to claim 1, wherein said paint layer includes an enamel coating, the enamel coating containing a pigment, such that the golf ball has a painted enamel surface.

8. The coated golf ball according to claim 1, wherein said paint layer comprises a pigment.

* * * * *